US011326751B2

(12) United States Patent
Jiang

(10) Patent No.: US 11,326,751 B2
(45) Date of Patent: May 10, 2022

(54) FLAME SIMULATING DEVICE AND METHOD

(71) Applicant: Xiangdong Jiang, Wuhan (CN)

(72) Inventor: Xiangdong Jiang, Wuhan (CN)

( * ) Notice: Subject to any disclaimer, the term of this patent is extended or adjusted under 35 U.S.C. 154(b) by 0 days.

(21) Appl. No.: 17/144,625

(22) Filed: Jan. 8, 2021

(65) Prior Publication Data

US 2021/0207783 A1 Jul. 8, 2021

Related U.S. Application Data

(60) Provisional application No. 62/958,650, filed on Jan. 8, 2020.

(51) Int. Cl.
*F21S 10/04* (2006.01)
*F21V 11/16* (2006.01)
*F21Y 113/10* (2016.01)

(52) U.S. Cl.
CPC ..... *F21S 10/046* (2013.01); *F21V 11/16* (2013.01); *F21Y 2113/10* (2016.08)

(58) Field of Classification Search
CPC ..... F21S 10/046
See application file for complete search history.

(56) References Cited

U.S. PATENT DOCUMENTS 6,363,636 B1 * 4/2002 Hess ..... F21S 10/04 40/428
8,250,792 B2 * 8/2012 Zhu ..... F24C 7/004 40/428
9,188,345 B1 * 11/2015 Lu ..... F24C 7/004
9,453,627 B1 * 9/2016 Chen ..... F21V 33/0056
10,584,841 B2 * 3/2020 Jones ..... F21S 10/04
10,852,001 B2 * 12/2020 Baird ..... G09F 19/16
2007/0094903 A1 * 5/2007 Hess ..... F24C 7/004 40/428
2007/0107280 A1 * 5/2007 Stinson ..... F24C 7/004 40/428
2010/0229849 A1 * 9/2010 Asofsky ..... F24C 7/004 126/500
2012/0155075 A1 * 6/2012 Asofsky ..... F24C 7/004 362/231
2015/0052791 A1 * 2/2015 Lu ..... F21S 10/046 40/428
2016/0169528 A1 * 6/2016 Lu ..... F24C 7/004 392/348

(Continued)

FOREIGN PATENT DOCUMENTS

CN 109307308 A * 2/2019
GB 2489384 A * 9/2012 ..... F24C 7/004
GB 2547013 A * 8/2017 ..... F21S 10/046

*Primary Examiner* — Alexander K Garlen
(74) *Attorney, Agent, or Firm* — Law Office of Scott C Harris, Inc

(57) ABSTRACT

A flame simulating device has a light source which is reflected by a rotating device which has mirrors which are spaced apart. The spaced apart mirrors rotate, and thus provide a selective reflection, at some points reflecting during time and at other points not reflecting during time. This produces a flickering effect. The flickering effect is shown through a cut out in the shape of the flame, to display a simulated flame devi effect. The display screen for the simulated effect can be a part mirror, and can display, for example, an artificial log mixed in with the flame effect.

19 Claims, 3 Drawing Sheets

(56) References Cited

U.S. PATENT DOCUMENTS

| | | | | |
|---|---|---|---|---|
| 2016/0258585 | A1* | 9/2016 | Gallo | F24C 7/004 |
| 2017/0167678 | A1* | 6/2017 | Gallo | F24C 7/004 |
| 2017/0268738 | A1* | 9/2017 | Jach | F21V 14/04 |
| 2018/0299086 | A1* | 10/2018 | Gallo | F21S 10/046 |
| 2018/0363867 | A1* | 12/2018 | Jones | F24B 1/1808 |
| 2019/0137059 | A1* | 5/2019 | Zhou | F21S 10/046 |
| 2020/0200392 | A1* | 6/2020 | Lu | F21S 10/046 |
| 2020/0363028 | A1* | 11/2020 | Lassen | F24C 7/004 |

* cited by examiner

FLAME SIMULATING DEVICE AND METHOD

This application claims priority from provisional application No. 62/958,650, filed Jan. 8, 2020, the entire contents of which are herewith incorporated by reference.

BACKGROUND

Flames have a specific form that changes over time in a stochastic way.

Artificial flames can be visually pleasing.

SUMMARY OF THE INVENTION

An embodiment describes a device that produces a three dimensional simulation view of a flame. In one embodiment, the device can be a display device, e.g., a display style fireplace.

The device has a light source, a reflector and an image screen on which the flame is viewed. The reflector has a motor, forming a rotating axis, rotating surface and reflecting elements. The reflecting elements can be blades that move or can be other kinds of reflecting pieces. The motor rotates to form a rotating axis between the motor and the image screen. The rotating surface is fixed on the rotating axis and rotates to change the reflection that is formed.

The rotating surface has some intermittent reflecting pieces, intermixed with non reflecting parts. The light from the light source is reflected onto the image screen by the reflecting pieces as the rotating surface is rotated, thereby producing realistic flickering flames.

BRIEF DESCRIPTION OF THE DRAWINGS

In the Drawings.

The figures show aspects of the invention.

DETAILED DESCRIPTION

Figure 1:
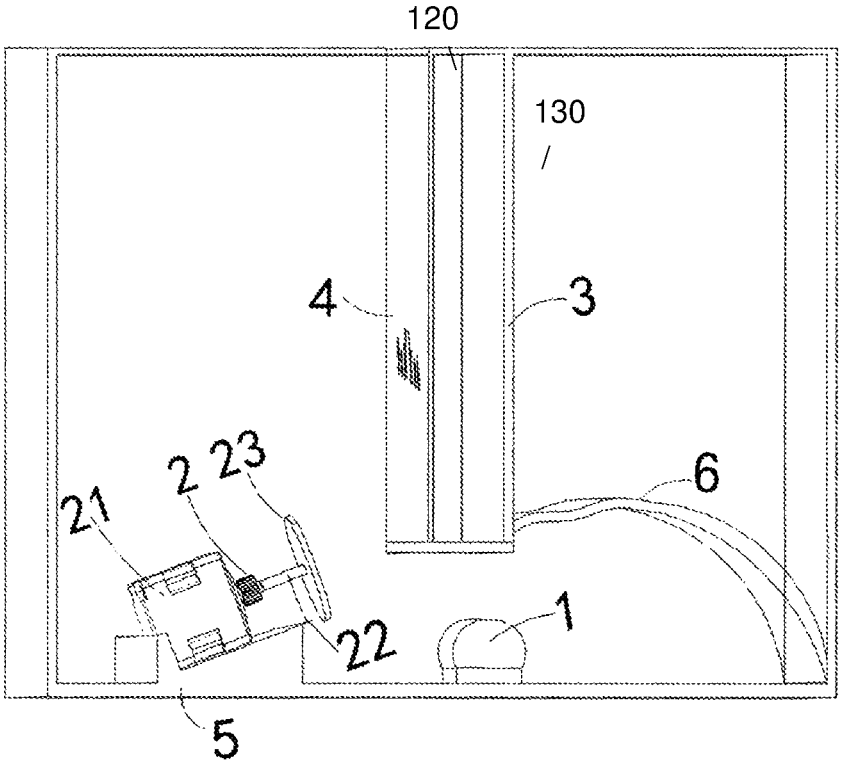
FIG. 1 is the total simulating assembly.

An embodiment is shown in FIG. 1. Light source 1 emits light that is selectively reflected by reflector 2 to be viewed on image screen 3. The light is selectively reflected in the sense that it at some times the light is reflected, and at other times the light is not reflected, forming a time series of reflected and non-reflected light. In an embodiment as shown in FIG. 1, the light source 1 is located in a location where the light emitted from light source 1 is not directly shown on the image screen 3. Only the reflected light, as reflected by the reflector 2, is reflected on the image screen 3.

Figure 2:
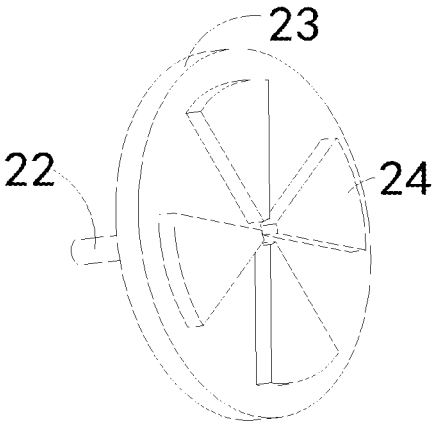
FIG. 2 is the reflecting element or blade.

The reflector 2 has a motor 21, which rotates a rotating surface 23 around a rotating axis 22. The rotating surface 23 is further shown in FIG. 2. The rotating surface 23 has discrete reflecting elements 24 which are separated by non reflecting areas. The rotating of the surface moves the reflecting elements intermittently into the location of the rotating surface that faces toward the light from light source 1. At the times during the rotation where the reflecting elements are between the light 2 and the screen, the light is seen on the screen. At other times during the rotation where the non reflecting elements are between the light 2 and the screen, no light is seen on the screen. In the embodiment, the reflecting elements 24 can be pie shaped blades or other shaped pieces.

In an embodiment, the reflecting elements 24 are steel reflecting blades, or mirrors, or any other material that reflects. By rotating the reflecting elements between the light source 1 and screen, the light from the light source 1 will be selectively reflected onto the image screen 3 by the reflecting elements 24 as they pass between the light source 1 and the screen 3. That is, as the rotating surface rotates around the rotating axis 24 based on rotation of the motor, the light will be selectively reflected by the reflecting elements 24, and either not reflected or less reflected by the areas between the adjacent reflecting elements 24. The reflecting elements 24 are spread around the axis in a fan-shape where different portions of the circular sectors have reflecting elements, and other portions of the circular sectors do not have those reflecting elements.

The rotating shaft 22 is attached to the motor 21 to rotate when driven by based on rotation by the motor. In one embodiment, the rotating shaft is fixed on the motor 21. The rotating shaft 22 forms a rotating axis that carries out the selective reflection between the light source 1 and the image screen 3.

FIG. 1 shows the embodiment that uses a flame shape board 4 that has cutouts that are in the shape of flames, to create flame shaped light from the non-shaped light emitted by the light source 1. The flame shape board 4 is located with its cutouts between the reflector 2 and the image screen 3, and above the light source 1, in a location such that light emitted from the light source 1 does not directly impinge on the flame shape board 4, but only impinges on the flame shape board after being reflected by the reflector elements 24.

Figure 3:
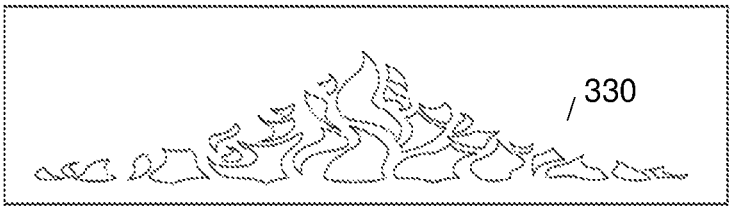
FIG. 3 is flame shape board with holes in first set of flame shapes.

FIG. 3 shows a first exemplary cut out shape 330 for a first flame shape board, which has the shape of flames. Those shape of flames are modulated by the lighting from the light is selectively reflected by the reflecting elements 24. As can be seen in FIG. 3, the flame cut outs are in the shape of multiple small flame shaped pieces forming a mound with the biggest and/or highest flame shape parts toward the center and on the top.

Figure 4:
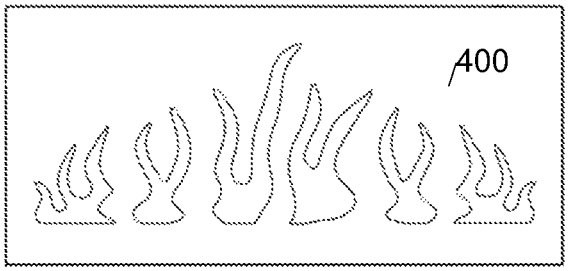
FIG. 4 shows an alternative flame shaped board with holes in alternative flame shapes.

FIG. 4 shows an alternative embodiment, where there the cut out shape 400 includes a number of flame shaped pieces, each of which are located next to one another, with the tallest and largest flames in the middle.

A support stand 5 holds the motor 21 at an angle set by the stand 5. The stand 5 can be adjusted for different angles and will allow the rotating axis 22 to face in different directions to rotate at different angles: up and down, left and right.

The image screen 3 is made of semi-transparent or diffusing material. The semitransparent material can be materials such as ABS material. The screen 3 has an illumination side 120 that faces toward the reflector 2 and the flame shaped board 4, and receives the light that is reflected by the reflector elements 24. The screen 3 also has a viewing side 130 not facing the reflector 2 and the flame shaped board, and that allows viewing the flame effect. In one embodiment, this can allow viewing colorful flames to be shown from the viewing side 130 of the image screen 3.

In an alternative embodiment, the viewing side 130 of the image screen 3 includes the viewing side 130 being silver plated to form either a full mirror or a semi-transparent mirror. The semi-transparent mirror reflects the object in its front and allows light from the back to be seen through to its front.

Figure 5:
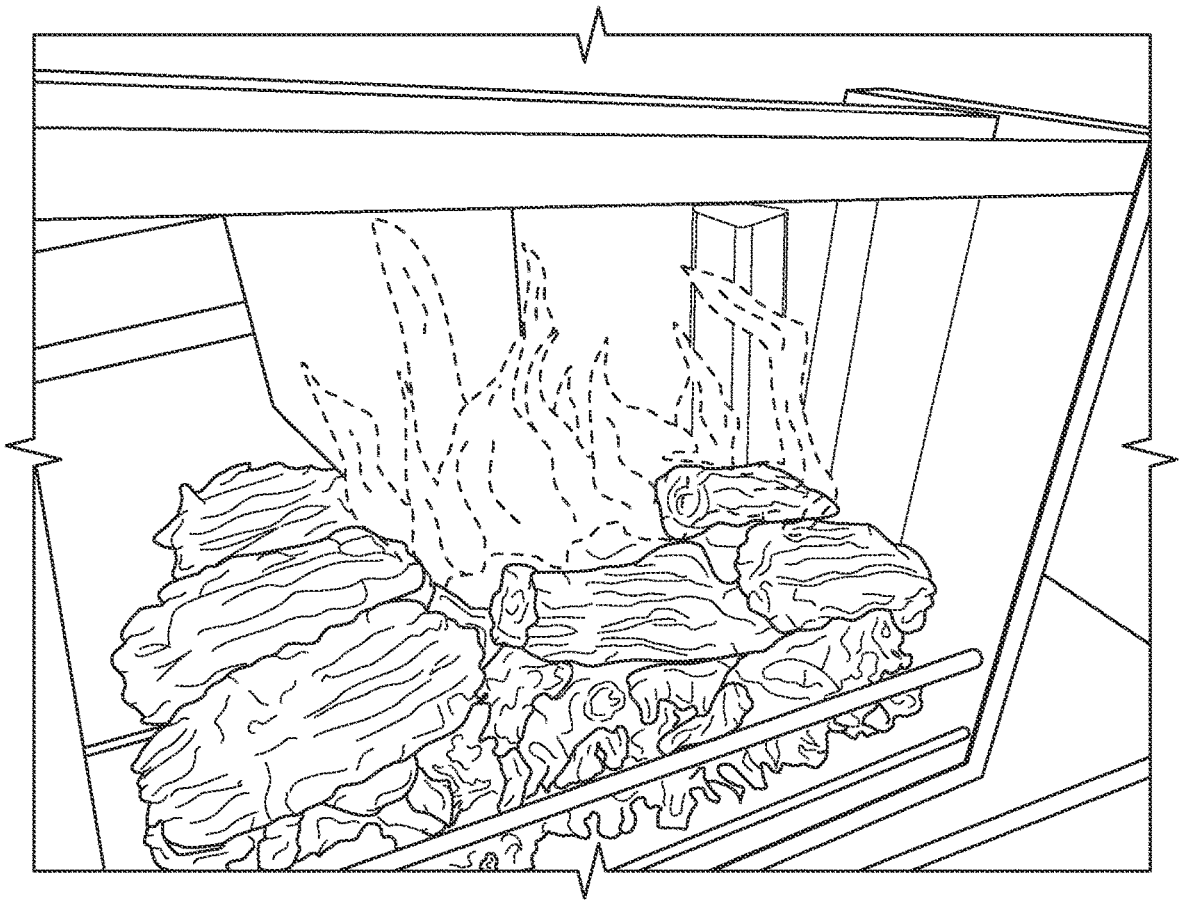
FIG. 5 shows an overall assembly.

In an embodiment where the image screen includes a full or partial mirror, artificial burning elements 6 such as an artificial log can be provided. These are also reflected and the reflection is also shown in the mirror, causing a visual doubling of the artificial log, to allow the front of the log to be seen directly, and also the reflection to be seen as a doubled view, as shown in FIG. 5. The flames produced by the reflecting blades/pieces 24 through the flame shape board 4 on the image screen 3 are seen flickering between the visually doubled burning elements 6, like real flames burning in or from the middle.

The mirror can also be used to simulate a 3D effect to the flame.

In an embodiment, the light source 1 is plural LEDs illuminating against the rotating axis 22.

In another embodiment, the multiple LEDs of the light source can be of different colors to produce colorful flames.

In another embodiment, side reflectors that are vertically disposed relative to the reflecting elements 24. These side reflectors can project flame light onto a side flame screen, e.g. left or right. This allows this embodiment to create simulated flames all of in front and in left or right side at the same time.

The previous description of the disclosed exemplary embodiments is provided to enable any person skilled in the art to make or use the present invention. Various modifications to these exemplary embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A light displaying device, comprising:

a light displaying screen, having a first viewing side, and having a second illumination side opposite to the viewing side;

a light source, creating a light output, the light source located in a location where the light output creates an output that is not directly impinging on the light displaying screen;

a reflector, having a selectively reflecting flat surface, the reflector located between the light source and the light displaying screen to receive the light output from the light source, the selectively reflecting surface including multiple first portions on the surface which reflect the light output from the light source, and including multiple second portions on the surface which do not reflect the light output from the light source, where the reflector is positioned in a location such that reflected light from the light source reflected toward the second illumination side of the light displaying screen, a motor, which continually moves the selectively reflecting surface of the reflector, where the motor has an axis that points toward the light displaying screen;

where the moving of the reflector continually moves the first surface between first locations where one of the first portions is in a path of the light output from the light source and reflects the light output from the light source towards the light displaying screen, and second locations where one of the second portions is in the path of the light output from the light source and does not reflect the light output towards the light displaying screen, and where the selectively reflecting surface has a second non-reflecting portion between each two first reflecting portions, in a direction of the moving of the reflector.

2. The light displaying device as in claim 1, wherein reflector is a flat disk shaped element, and the motor rotates the reflector between alternate first reflecting portions and second nonreflecting portions to selectively reflect the light towards the second illumination side at said first points of moving of the moving reflector where the first reflecting portion is between the light output from the light source and the light displaying screen, and to not reflect the light to the second illumination side at other points of moving of the reflector where the second nonreflecting portion is between the light output from the light source and the light displaying screen, to thereby selectively reflect the light towards the second illumination side during rotating of the reflector.

3. The light displaying device as in claim 1, where further comprising a cut out shape, between the reflector and the second side of the illumination screen, the cut out shape allowing light to pass inside the cut out shape, and not allowing the light to pass outside the cut out shape.

4. The light displaying device as in claim 2, further comprising a cutout shape, between the reflector and the second side of the illumination screen.

5. The light displaying device as in claim 4, wherein the cutout shape is in the shape of flames and where the light displaying device displays a simulated flame.

6. The light displaying device as in claim 5, wherein the cutout shapes are in the shape of multiple small flame shaped pieces forming a mound.

7. The light displaying device as in claim 5, wherein the cutout shapes includes a number of flame shaped pieces, each of which are located next to one another.

8. The light displaying device as in claim 1 wherein the light displaying screen is formed of a semitransparent material.

9. The light displaying device as in claim 1 wherein the light displaying screen includes a mirror to reflect an object on the viewing side, and allows light from the illumination side to be seen through to its front.

10. The light displaying device as in claim 9, wherein the mirror is a partial mirror.

11. The light displaying device as in claim 9, further comprising an artificial burning element, on the viewing side of the light displaying screen, and where the artificial burning element is reflected by the mirror of the light displaying screen.

12. The light displaying device as in claim 11, wherein the artificial burning element is an artificial log.

13. The light displaying device as in claim 1, wherein the light source comprises multiple different light sources of multiple different colors.

14. The light displaying device as in claim 5, wherein the light source displays multiple different colors, thus displaying the flame in multiple different colors.

15. The light displaying device as in claim 2, wherein the reflector has multiple pie shaped blades as said first reflecting portions, each pie shaped blade comprising a sector of the disk shape defined by two straight radius lines as its sides, which intersect at a center of the disk shaped element, and a curved edge and pie shaped second nonreflecting portions in between each two reflecting portions.

16. A simulated flame displaying device, comprising:

a light displaying screen, having a first viewing side, and having a second illumination side opposite to the viewing side;

a light source, creating a light output, the light source located in a location where the light output creates an output that is not directly impinging on the light displaying screen;

a motor that has an axis that points toward the light displaying screen;

a rotating reflector, coupled to be rotated by the motor, the reflector being a flat, disk shaped element, having a reflecting surface which includes multiple first portions that reflect the light output from the light source to the light displaying screen, and multiple second portions, each second portion in between each two first portions, the second portions that do not reflect the light output from the light source to the light displaying screen, the reflector located between the light source and the light displaying screen, the reflector located in a location to receive the light output from the light source, and located to reflect the light output received from the light source as reflected light toward the light displaying screen when one of the reflecting first portions is in the path of the light output and not reflecting the light output received from light source when one of the nonreflecting second portions is in the path of light output from the light source, and a cut out shape, between the reflector and the second side of the illumination screen, the cut out shape allowing light to pass inside the cut out shape, and not allowing the light to pass outside the cut out shape, wherein the cutout shape is in the shape of flames.

17. The light displaying device as in claim 16 wherein the light displaying screen includes a mirror to reflect an object on the viewing side, and allows light from the illumination side to be seen through to its front.

18. The light displaying device as in claim 16, wherein the light source comprises multiple different light sources of multiple different colors.

19. The flame displaying device as in claim 16, wherein the reflector has multiple pie shaped blades as said first reflecting portions, each pie shaped blade comprising a section of the disk-shaped element, and pie shaped second nonreflecting portions in between each two reflecting portions.

* * * * *